US009232585B2

(12) United States Patent
Chen et al.

(10) Patent No.: US 9,232,585 B2
(45) Date of Patent: Jan. 5, 2016

(54) BACKLIGHT REGULATION CIRCUIT AND LIQUID CRYSTAL DISPLAY

(71) Applicant: SHENZHEN CHINA STAR OPTOELECTRONICS TECHNOLOGY CO., LTD., Shenzhen, Guangdong (CN)

(72) Inventors: Xinhong Chen, Guangdong (CN); Xiang Yang, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 67 days.

(21) Appl. No.: 14/130,322

(22) PCT Filed: Dec. 3, 2013

(86) PCT No.: PCT/CN2013/088426

§ 371 (c)(1),
(2) Date: Dec. 31, 2013

(87) PCT Pub. No.: WO2015/074293

PCT Pub. Date: May 28, 2015

(65) Prior Publication Data

US 2015/0208473 A1 Jul. 23, 2015

(30) Foreign Application Priority Data

Nov. 25, 2013 (CN) ..... 2013 1 0607027

(51) Int. Cl.

| | |
|---|---|
| ***H05B 37/02*** | (2006.01) |
| ***H05B 33/08*** | (2006.01) |
| ***G09G 3/34*** | (2006.01) |
| *G09G 3/36* | (2006.01) |

(52) U.S. Cl.

CPC ..... *H05B 33/0818* (2013.01); *G09G 3/3406* (2013.01); *H05B 37/02* (2013.01); *H05B37/0281* (2013.01); *G09G 3/3648* (2013.01); *G09G 2320/064* (2013.01); *G09G 2354/00* (2013.01)

(58) Field of Classification Search

CPC ..... H05B 37/02
USPC ..... 315/291, 294, 297, 307, 308; 345/102
See application file for complete search history.

(56) References Cited

U.S. PATENT DOCUMENTS

2009/0045758 A1* 2/2009 Chida ..... 315/307

(Continued)

FOREIGN PATENT DOCUMENTS

CN 101854759 A 10/2010

OTHER PUBLICATIONS

1st Office Action of counterpart Chinese Patent Application No. 201310607027.2 issued on Aug. 28, 2015.

*Primary Examiner* — Tung X Le

(57) ABSTRACT

The present disclosure provides a backlight regulation circuit and a liquid crystal display having the same. The backlight regulation circuit includes a PWM signal generating module, a D/A conversion module, and a current driving module. The PWM signal generating module is configured for generating a PWM signal and outputting the PWM signal to the current driving module; the D/A conversion module receives an operation command inputted by user and outputs a preset voltage to the current driving module according to the operation command; the current driving module receives the PWM signal, amplifies the PWM signal according to the preset voltage, and outputs the amplified PWM signal to an electrical switch in control of switch-on and switch-off of a backlight, thereby controlling the switch-on and switch-off of the backlight. The present disclosure integrates multiple LED backlight schemes, expands the application range of the backlight regulation circuit, and shortens the development cycle.

14 Claims, 1 Drawing Sheet

(56) References Cited

U.S. PATENT DOCUMENTS

2009/0284171 A1* 11/2009 Bayadroun ..... H05B 33/0803 315/294
2010/0026208 A1* 2/2010 Shteynberg et al. ..... 315/297
2010/0289424 A1* 11/2010 Chang ..... H05B 33/0818 315/250
2011/0062872 A1* 3/2011 Jin et al. ..... 315/122
2013/0147375 A1* 6/2013 Williams et al. ..... 315/192

* cited by examiner

BACKLIGHT REGULATION CIRCUIT AND LIQUID CRYSTAL DISPLAY

BACKGROUND

1. Technical Field

The present disclosure relates to technologies of liquid crystal displays, and more particularly, to a backlight regulation circuit and a liquid crystal display having the same.

2. Description of Related Art

It is known that at present a MCU as well as a special LED driver IC is adopted to drive multiple LED strings for achieving current balance and brightness regulation. When choosing the special LED driver IC, according to the structure of the backlight, it is often necessary to choose different LED driver ICs for debugging. Moreover, this type of driving structure requires multiple peripheral circuits, which extends the development cycle.

SUMMARY

The main object of the present disclosure is to provide a backlight regulation circuit for integrating multiple types of backlight schemes, expanding the application range of the backlight regulation circuit, and shortening the development cycle.

The backlight regulation circuit provided in the present disclosure includes a pulse-width-modulation (PWM) signal generating module, a digital-to-analogy (D/A) conversion module, and a current driving module. The PWM signal generating module is configured for generating a PWM signal and outputting the PWM signal to the current driving module. The D/A conversion module receives an operation command inputted by user and outputs a preset voltage to the current driving module according to the operation command inputted by the user. The current driving module receives the PWM signal, amplifies the PWM signal according to the preset voltage, and outputs the amplified PWM signal to an electrical switch which is in control of switch-on and switch-off of a backlight, thereby controlling the switch-on and switch-off of the backlight.

Preferably, the backlight regulation further includes a receiving module, a storing module, and a control module; the receiving module is configured for receiving a backlight duty data and a backlight delay data; the storing module is configured for storing the backlight duty data; and the control module controls a time of a logic high level signal outputted from the PWM signal generating module according to the backlight duty data and controls a time of a logic low level signal outputted from the PWM signal generating module according to the backlight delay data.

Preferably, the storing module includes a first storing unit configured for storing the backlight delay data and a second storing unit configured for storing the backlight duty data.

Preferably, the control module includes a first counter and a second counter; the first counter reads the backlight delay data stored in the first storing unit and outputs a first control signal to the PWM signal generating module at a trigger point of a frame display synchronization signal; the PWM signal generating module outputs a logic low level signal according to the first control signal; when a count value of the first counter is equal to a value of the backlight delay data, the first counter outputs a second control signal to the PWM signal generating module and the second counter which controls the second counter to start to count and controls the PWM signal generating module to output a logic high level signal; when a count value of the second counter is equal to a value of the backlight duty data, the second counter outputs a third control signal to the PWM signal generating module, and the PWM signal generating module outputs a logic low level signal according to the third control signal.

Preferably, the receiving module is a serial interface circuit.

Preferably, the electrical switch is a transistor and the current driving module is an operational amplifier; a non-inverting input terminal of the operational amplifier is connected to an output terminal of the PWM signal generating module and an output terminal of the D/A conversion module, an inverting input terminal of the operational amplifier is connected to an emitter of the transistor, and an output terminal of the operational amplifier is connected to a base of the transistor.

Preferably, the backlight regulation circuit further includes an analogy-to-digital (A/D) conversion module with an input terminal thereof being connected to a collector of the transistor, and the A/D conversion module outputs a control signal to control a working state of the backlight according to a voltage detected by the input terminal thereof.

Preferably, the backlight regulation circuit is an integrated circuit.

The liquid crystal display provided in the present disclosure includes a backlight regulation circuit. The backlight regulation circuit includes a pulse-width-modulation (PWM) signal generating module, a digital-to-analogy (D/A) conversion module, and a current driving module. The PWM signal generating module is configured for generating a PWM signal and outputting the PWM signal to the current driving module. The D/A conversion module receives an operation command inputted by user and outputs a preset voltage to the current driving module according to the operation command inputted by the user. The current driving module receives the PWM signal, amplifies the PWM signal according to the preset voltage, and outputs the amplified PWM signal to an electrical switch which is in control of switch-on and switch-off of a backlight, thereby controlling the switch-on and switch-off of the backlight.

Preferably, the backlight regulation further includes a receiving module, a storing module, and a control module; the receiving module is configured for receiving a backlight duty data and a backlight delay data; the storing module is configured for storing the backlight duty data; and the control module controls a time of a logic high level signal outputted from the PWM signal generating module according to the backlight duty data and controls a time of a logic low level signal outputted from the PWM signal generating module according to the backlight delay data.

Preferably, the storing module includes a first storing unit configured for storing the backlight delay data and a second storing unit configured for storing the backlight duty data.

Preferably, the control module includes a first counter and a second counter; the first counter reads the backlight delay data stored in the first storing unit and outputs a first control signal to the PWM signal generating module at a trigger point of a frame display synchronization signal; the PWM signal generating module outputs a logic low level signal according to the first control signal; when a count value of the first counter is equal to a value of the backlight delay data, the first counter outputs a second control signal to the PWM signal generating module and the second counter which controls the second counter to start to count and controls the PWM signal generating module to output a logic high level signal; when a count value of the second counter is equal to a value of the backlight duty data, the second counter outputs a third control signal to the PWM signal generating module, and the PWM signal generating module outputs a logic low level signal according to the third control signal.

Preferably, the receiving module is a serial interface circuit.

Preferably, the electrical switch is a transistor and the current driving module is an operational amplifier; a non-inverting input terminal of the operational amplifier is connected to an output terminal of the PWM signal generating module and an output terminal of the D/A conversion module, an inverting input terminal of the operational amplifier is connected to an emitter of the transistor, and an output terminal of the operational amplifier is connected to a base of the transistor.

Preferably, the backlight regulation circuit further includes an analogy-to-digital (A/D) conversion module with an input terminal thereof being connected to a collector of the transistor, and the A/D conversion module outputs a control signal to control a working state of the backlight according to a voltage detected by the input terminal thereof.

Preferably, the backlight regulation circuit is an integrated circuit.

The D/A conversion module of the present disclosure changes the voltage inputted to the current driving module and thus regulates the driving current of the backlight. Being applicable to backlights with different driving currents, the backlight regulation circuit provided in the present disclosure can integrates multiple LED backlight schemes. Therefore, the present disclosure expands the application range of the backlight regulation circuit and shortens the development cycle.

DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment is this disclosure are not necessarily to the same embodiment, and such references mean at least one.

The present disclosure provides a backlight regulation circuit.

Figure 1:
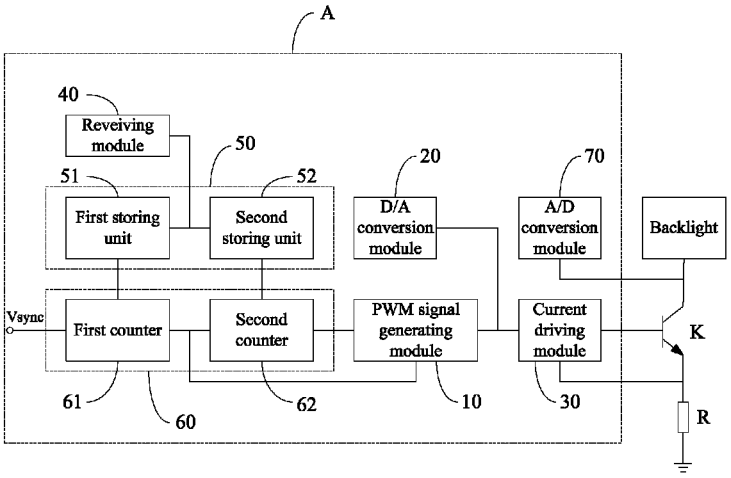
FIG. 1 is a schematic view of a backlight regulation circuit in accordance with a first embodiment of the present disclosure.
Figure 2:
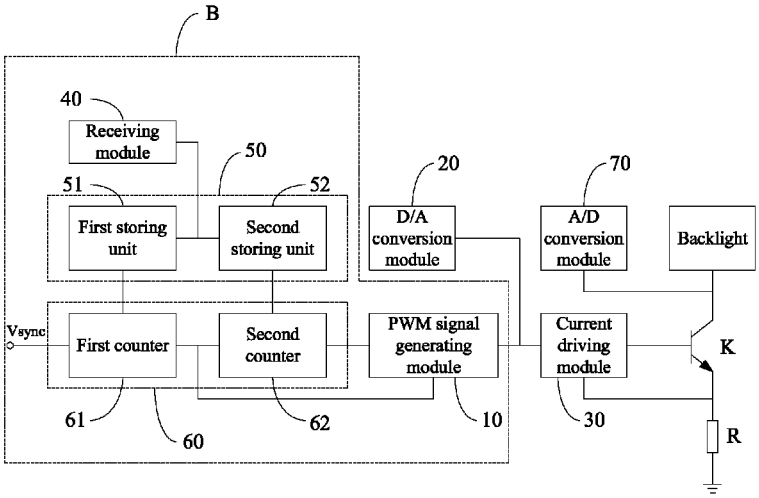
FIG. 2 is a schematic view of a backlight regulation circuit in accordance with a second embodiment of the present disclosure.

Referring to FIGS. 1 and 2, in which FIG. 1 is a schematic view of the backlight regulation circuit in accordance with a first embodiment of the present disclosure and FIG. 2 is a schematic view of the backlight regulation circuit in accordance with a second embodiment of the present disclosure, the backlight regulation circuit provided in the present disclosure includes a pulse-width-modulation (PWM) signal generating module 10, a digital-to-analogy (D/A) conversion module 20, and a current driving module 30.

The PWM signal generating module 10 is configured for generating a PWM signal and outputting the PWM signal to the current driving module 30.

The D/A conversion module 20 receives an operation command inputted by user and outputs a preset voltage to the current driving module 30 according to the operation command inputted by the user.

The current driving module 30 receives the PWM signal, amplifies the PWM signal according to the preset voltage, and outputs the amplified PWM signal to an electrical switch K which controls switch-on and switch-off of a backlight, thereby controlling the switch-on and switch-off of the backlight.

In an embodiment, the PWM signal generating module 10 can be an integrated circuit, and the D/A conversion module 20 and the current driving module 30 can be peripheral circuits of the integrated circuit. As shown in FIG. 2, the region labeled as B is an integrated circuit region. In another embodiment, the D/A conversion module 20 and the current driving module 30 can be integrated into the MCU to form an integrated circuit. As shown in FIG. 1, the region labeled as A is an integrated region. In yet another embodiment, the PWM signal generating module 10, the D/A conversion module 20, and the current driving module 30 can be printed on a circuit board in independent circuit forms.

The preset voltage outputted from the D/A conversion module 20 can be adjusted according to actual requirements, for example, an operation interface can be provided to allow the user to set parameters; after the user inputs a current, the D/A conversion module 20 at first determines the preset voltage outputted to the current driving module 30 according to the user input, and further outputs the preset voltage to the current driving module 30.

In the present disclosure, the D/A conversion module 20 changes the voltage inputted to the current driving module 30 and thus regulates the driving current of the backlight. By being applicable to backlight with different driving currents, the backlight regulation circuit provided in the present disclosure can integrate various LED backlight schemes. Therefore, the application range of the backlight regulation circuit is expanded and the development circle is shortened.

Based on what's described above, the backlight regulation circuit of the embodiment further includes a receiving module 40, a storing module 50, and a control module 60. The receiving module 40 is configured for receiving a backlight duty data and a backlight delay data; the storing module 40 is configured for storing the backlight duty data and the backlight delay data; and the control module 60 controls a time of a logic high level signal outputted from the PWM signal generating module according to the backlight duty data, and controls a time of a logic low level signal outputted from the PWM signal generating module according to the backlight delay data.

In detail, the way that the backlight duty data and the backlight delay data are stored can be set according to actual requirements. In the embodiment, the backlight duty data and the backlight delay data are separately and independently stored. The storing module 50 includes a first storing unit 51 for storing the backlight delay data and a second storing unit 52 for storing the backlight duty data. On the basis that the receiving module 40 is capable of receiving the backlight duty data and the backlight delay data outputted from a master control IC (Timing control) of a TFT-LCD, the circuit structure of the receiving module 40 can be arranged according to actual requirements. In the embodiment, the receiving module 40 is preferably a serial interface circuit.

In the embodiment, after receiving the backlight duty data and the backlight delay data outputted from the Timing control, the receiving module 40 stores the backlight delay data into the first storing unit 51 and stores the backlight duty data into the second storing unit 52. The control module 60 reads the backlight delay data stored in the first storing unit 51 and the backlight duty data stored in the second storing unit 52, and converts the backlight duty data and backlight delay data into time data. In detail, the control module 60 converts the backlight delay data into a backlight switch-off time (it is noted that the backlight switch-off time refers to a required extended time from the frame input to the frame display in a display cycle), and converts the backlight duty data into a backlight switch-on time. At first, at a trigger point of a frame display synchronization signal Vsync, the control module 60 controls the PWM signal generating module 10 at first to output a logic low level signal lasting for a time having the same length as that of the backlight switch-off time, then to output a logic high level signal lasting for a time having the same length as that of the backlight switch-on time, and subsequently to output a logic low level signal. In this way, the frame display in a time cycle is finished. The above operation is repeated when the next trigger point of the frame display synchronization signal Vsync comes.

Furthermore, the control module 60 includes a first counter 61 and a second counter 62.

The first counter 61 reads the backlight delay data stored in the first storing unit 51 and outputs a first control signal to the PWM signal generating module 10 at the trigger point of the frame display synchronization signal Vsync. The PWM signal generating module 10 outputs a logic low level signal according to the first control signal. When a count value of the first counter 61 is equal to a value of the backlight delay data, the first counter 61 outputs a second control signal to the PWM signal generating module 10 and the second counter 62 which controls the second counter 62 to start to count and controls the PWM signal generating module 10 to output a logic high level signal. When a count value of the second counter 62 is equal to a value of the backlight duty data, the second counter 62 outputs a third control signal to the PWM signal generating module 1. The PWM signal generating module 10 outputs a logic low level signal according to the third control signal.

In the embodiment, the value of the backlight delay data and the value of the backlight duty data can be obtained via algorism preset inside the Timing control. The following is an example based on that the value of the backlight delay data is 50 and the backlight duty data is 100. The first counter 61 receives the frame display synchronization signal Vsync, starts to count at the trigger point of the frame display synchronization signal Vsync, and outputs the first control signal to control the PWM signal generating module 10 to output a logic low level signal. When the count value of the first counter 61 reaches 50, the first counter 61 outputs the second control signal to control the PWM signal generating module 10 to output a logic high level signal and to control the second counter 62 to start to count. When the count value of the second counter 62 reaches 100, the second counter 62 outputs the third control signal to control the PWM signal generating module 10 to output a logic low level signal. In this way, the frame display in a cycle is finished. The above operation is repeated when the next trigger point of the frame display synchronization signal Vsync comes.

In detail, the electrical switch K is a transistor and the current driving module 30 is an operational amplifier. A non-inverting terminal of the operational amplifier is connected to an output terminal of the PWM signal generating module 10 and an output terminal of the D/A conversion module 20, an inverting terminal of the operational amplifier is connected to an emitter of the transistor, and an output terminal of the operational amplifier is connected to a base of the transistor.

In the embodiment, the transistor is a NPN-type transistor with an emitter thereof connected to ground through a resistor and a collector thereof connected to the backlight.

Based on what's described, the backlight regulation circuit of the embodiment further includes an analogy-to-digital (A/D) conversion module 70 with an input terminal thereof connected to a collector of the transistor. The A/D conversion module 70 analyzes a working state of the backlight according to the voltage detected by the input terminal thereof.

In the embodiment, the A/D conversion module 70 detects the voltage of the collector of the transistor and thus is capable of determining whether the backlight works normally according to the voltage of the collector of the transistor. If there is LED open circuit or LED short circuit in the backlight, the A/D conversion module 70 outputs a corresponding signal to a protection circuit, thereby achieving short circuit protection and open circuit protection.

It is noted that in the embodiment, in order to shorten the development cycle and reduce the difficulty of the circuit design, the backlight regulation circuit is preferably designed to be an integrated circuit. Compared to the conventional MCU which is configured for outputting the PWM signal, the integration level of the chip is improved.

The present disclosure further provides a liquid crystal display. The liquid crystal display includes a backlight regulation circuit and the structure of the backlight regulation circuit can refer to that of the backlight regulation circuit described above, which is not given in detail herein. Since the liquid crystal display adopts the above backlight regulation circuit, correspondingly, the liquid crystal display has the beneficial effect of the backlight regulation circuit described above.

Even though information and the advantages of the present embodiments have been set forth in the foregoing description, together with details of the mechanisms and functions of the present embodiments, the disclosure is illustrative only; and that changes may be made in detail, especially in matters of shape, size, and arrangement of parts within the principles of the present embodiments to the full extend indicated by the broad general meaning of the terms in which the appended claims are expressed.

What is claimed is:

1. A backlight regulation circuit, comprising a pulse-width-modulation (PWM) signal generating module, a digital-to-analogy (D/A) conversion module, and a current driving module;

the PWM signal generating module being configured for generating a PWM signal and outputting the PWM signal to the current driving module;

the D/A conversion module receiving an operation command inputted by user and outputting a preset voltage to the current driving module according to the operation command inputted by the user;

the current driving module receiving the PWM signal, amplifying the PWM signal according to the preset voltage, and outputting the amplified PWM signal to an electrical switch which is in control of switch-on and switch-off of a backlight, thereby controlling the switch-on and switch-off of the backlight;

further comprising a receiving module, a storing module, and a control module; the receiving module is configured for receiving a backlight duty data and a backlight delay data; the storing module is configured for storing the backlight duty data; and the control module controls a time of a logic high level signal outputted from the PWM signal generating module according to the backlight duty data and controls a time of a logic low level signal outputted from the PWM signal generating module according to the backlight delay data.

2. The backlight regulation circuit of claim 1, wherein the storing module comprises a first storing unit configured for storing the backlight delay data and a second storing unit configured for storing the backlight duty data.

3. The backlight regulation circuit of claim 2, wherein the control module comprises a first counter and a second counter; the first counter reads the backlight delay data stored in the first storing unit and outputs a first control signal to the PWM signal generating module at a trigger point of a frame display synchronization signal; the PWM signal generating module outputs a logic low level signal according to the first control signal; when a count value of the first counter is equal to a value of the backlight delay data, the first counter outputs a second control signal to the PWM signal generating module and the second counter which controls the second counter to start to count and controls the PWM signal generating module to output a logic high level signal; when a count value of the second counter is equal to a value of the backlight duty data, the second counter outputs a third control signal to the PWM signal generating module, and the PWM signal generating module outputs a logic low level signal according to the third control signal.

4. The backlight regulation circuit of claim 1, wherein the receiving module is a serial interface circuit.

5. The backlight regulation circuit of claim 1, wherein the electrical switch is a transistor and the current driving module is an operational amplifier; a non-inverting input terminal of the operational amplifier is connected to an output terminal of the PWM signal generating module and an output terminal of the D/A conversion module, an inverting input terminal of the operational amplifier is connected to an emitter of the transistor, and an output terminal of the operational amplifier is connected to a base of the transistor.

6. The backlight regulation circuit of claim 5 further comprising an analogy-to-digital (A/D) conversion module with an input terminal thereof being connected to a collector of the transistor, the A/D conversion module outputs a control signal to control a working state of the backlight according to a voltage detected by the input terminal thereof.

7. The backlight regulation circuit of claim 1, wherein the backlight regulation circuit is an integrated circuit.

8. A liquid crystal display comprising a backlight regulation circuit, the backlight regulation circuit comprising a pulse-width-modulation (PWM) signal generating module, a digital-to-analogy (D/A) conversion module, and a current driving module;

the PWM signal generating module being configured for generating a PWM signal and outputting the PWM signal to the current driving module;

the D/A conversion module receiving an operation command inputted by user and outputting a preset voltage to the current driving module according to the operation command inputted by the user;

the current driving module receiving the PWM signal, amplifying the PWM signal according to the preset voltage, and outputting the amplified PWM signal to an electrical switch which is in control of switch-on and switch-off of a backlight, thereby controlling the switch-on and switch-off of the backlight;

further comprising a receiving module, a storing module, and a control module; the receiving module is configured for receiving a backlight duty data and a backlight delay data; the storing module is configured for storing the backlight duty data; and the control module controls a time of a logic high level signal outputted from the PWM signal generating module according to the backlight duty data and controls a time of a logic low level signal outputted from the PWM signal generating module according to the backlight delay data.

9. The liquid crystal display of claim 8, the storing module comprises a first storing unit configured for storing the backlight delay data and a second storing unit configured for storing the backlight duty data.

10. The liquid crystal display of claim 9, wherein the control module comprises a first counter and a second counter; the first counter reads the backlight delay data stored in the first storing unit and outputs a first control signal to the PWM signal generating module at a trigger point of a frame display synchronization signal; the PWM signal generating module outputs a logic low level signal according to the first control signal; when a count value of the first counter is equal to a value of the backlight delay data, the first counter outputs a second control signal to the PWM signal generating module and the second counter which controls the second counter to start to count and controls the PWM signal generating module to output a logic high level signal; when a count value of the second counter is equal to a value of the backlight duty data, the second counter outputs a third control signal to the PWM signal generating module, and the PWM signal generating module outputs a logic low level signal according to the third control signal.

11. The liquid crystal display of claim 8, wherein the receiving module is a serial interface circuit.

12. The liquid crystal display of claim 8, wherein the electrical switch is a transistor and the current driving module is an operational amplifier; a non-inverting input terminal of the operational amplifier is connected to an output terminal of the PWM signal generating module and an output terminal of the D/A conversion module, an inverting input terminal of the operational amplifier is connected to an emitter of the transistor, and an output terminal of the operational amplifier is connected to a base of the transistor.

13. The liquid crystal display of claim 12 further comprising an analogy-to-digital (A/D) conversion module with an input terminal thereof being connected to a collector of the transistor, the A/D conversion module outputs a control signal to control a working state of the backlight according to a voltage detected by the input terminal thereof.

14. The liquid crystal display of claim 8, wherein the backlight regulation circuit is an integrated circuit.

* * * * *